US005461944A

United States Patent [19]

Ciumaga

[11] Patent Number: 5,461,944

[45] Date of Patent: Oct. 31, 1995

[54] METHOD OF MAKING A SCREWDRIVER

[76] Inventor: Massimo Ciumaga, P.O. Box 57028, Oklahoma, Okla. 73107

[21] Appl. No.: 261,415

[22] Filed: Jun. 17, 1994

Related U.S. Application Data

[63] Continuation-in-part of Ser. No. 54,405, Apr. 28, 1993, abandoned, which is a continuation-in-part of Ser. No. 905,163, Jun. 25, 1992, abandoned, which is a continuation of Ser. No. 392,822, Aug. 11, 1989, which is a continuation-in-part of Ser. No. 944,470, Dec. 8, 1986, Pat. No. 4,873,900.

[51] Int. Cl.[6] ..... B25B 13/48

[52] U.S. Cl. ..... 76/119; 83/436

[58] Field of Search ..... 76/119, 101.1; 81/436, 451, 456, 460, 461; D8/82, 86

[56] References Cited

U.S. PATENT DOCUMENTS

| | | | |
|---|---|---|---|
| D. 112,592 | 12/1938 | Velepec . | |
| D. 229,475 | 12/1973 | Uboldi . | |
| 417,722 | 12/1889 | Hart | 81/436 |
| 1,479,506 | 1/1924 | Kellemen . | |
| 1,787,087 | 12/1930 | Robertson | 81/436 |
| 2,142,185 | 1/1939 | Fieg | 81/436 |
| 2,678,578 | 5/1954 | Bonano | 81/436 |
| 2,684,094 | 7/1954 | Lissy | 145/50 |
| 2,788,817 | 4/1957 | Leniz | 81/436 |
| 2,796,101 | 6/1957 | Hasemann et al. | 145/61 |
| 3,405,748 | 10/1968 | Sorteberg . | |
| 3,897,812 | 8/1975 | Arnn . | |
| 3,923,088 | 12/1975 | Arnn | 81/436 |
| 4,105,056 | 8/1978 | Arnn . | |
| 4,311,071 | 1/1982 | Bassell . | |
| 4,339,971 | 7/1982 | Zatorre . | |
| 4,716,797 | 1/1988 | Colvin | 81/436 |
| 4,878,406 | 11/1989 | Simpson et al. | 81/436 |
| 4,977,800 | 12/1990 | Colvin | 81/436 |
| 5,001,948 | 3/1991 | Weible et al. | 81/436 |
| 5,105,690 | 4/1992 | Lazzara et al. | 81/436 |

FOREIGN PATENT DOCUMENTS

| | | | |
|---|---|---|---|
| 1009347 | 3/1952 | France | 81/436 |
| 5270 | 11/1946 | Germany . | |
| 2524995 | 12/1976 | Germany . | |
| 8605955 | 6/1988 | Germany . | |
| 2131114A | 6/1984 | United Kingdom . | |

OTHER PUBLICATIONS

Tytan Brochure–*The Tytan Driver,* 1991.
Enderes Tools–Brochure.
Cooper Industries Catalog Entry for Crescent Series 1500 Screwdrivers.
Cooper Industries Catalog Entry for Crescent Series 2000 Screwdrivers.
Consumer Reports, Aug. 1994, pp. 533–535.
1994 Brookstone Catalog, p. 33.
American Machinist, Aug. 29, 1946, p. 126.
Max Baumann & Co. Ag Screwdriver Brochure (pre–1992).
A. Levensetter, "Fachkunde Für metallverarbeitende Berufe", Ed. 17, 1957, p. 189.
Tytan Driver Brochure.

*Primary Examiner*—Douglas D. Watts
*Attorney, Agent, or Firm*—Pravel, Hewitt, Kimball, Krieger

[57] ABSTRACT

A screwdriver includes an enlarged blade and a straight bit with parallel opposing surfaces. The surfaces apply torque to a screw slot over an increased area and reduce the tendency of the bit to slip out of the slot as compared to conventional commercially available screwdrivers. The screwdrivers are preferably made of hardened high quality steel so that they will be strong enough to withstand a substantial amount of torque.

10 Claims, 4 Drawing Sheets

METHOD OF MAKING A SCREWDRIVER

CROSS REFERENCE TO RELATED APPLICATIONS

This is a continuation-in-part of U.S. patent application Ser. No. 08/054,405, filed Apr. 28, 1993, now abandoned, which is a continuation-in-part of U.S. patent application Ser. No. 07/905,163, filed Jun. 25, 1992, now abandoned, which is a continuation of U.S. patent application Ser. No. 07/392,822, filed Aug. 11, 1989 pending, which is a continuation-in-part of U.S. patent application Ser. No. 06/944,470, filed Dec. 8, 1986, now U.S. Pat. No. 4,873,900, all hereby incorporated by reference.

BACKGROUND OF THE INVENTION

1. Field of the Invention

The invention is a type of tool for use in turning fastening devices. The fastening devices relevant could be screws, whether machine, wood, or sheet metal type, bolts, cam-lock fasteners, or any other device which is operated by introducing torque at one end. The tool can be directly hand driven, turned by a hand wrench, or turned by an impact wrench.

2. Description of the Related Art

The typical screw type slotted head fastener in use is driven by introducing a torque to a slot in the head of the screw by use of a screw driver. The same method is used whether the screw is driven clockwise or counterclockwise, whether tightening or loosening. The most troublesome faults with this method of driving screws are that the screw driver tends to come out of the slot under high torque and that the outer edges of the slot tend to chip or deform when slippage occurs or when repetitive installation and removal are necessary.

The typical screw driver has a tapered blade which fits into the screw slot, which, conversely, has parallel faces. The result of this combination is that the end of the blade is narrow by comparison with the width of the slot, allowing the screw driver axis to be at an angle with the axis of the screw. In addition, the contact between the screw driver and the screw is made at the top edge of the slot, where the screw contacts the tapered edge of the screw driver blade at two points. When torque is applied to the screw driver, the axial misalignment and point contact cause one component of the force applied to push the screw driver out of the slot. This is the first fault alluded to above. The second fault is related. When the screw driver slips out of the slot because of this mismatch of tapered and parallel surfaces, the top edge of the slot frequently chips or burrs because the point loading exceeds the material strength just prior to the blade clearing the slot. Further, even if wholesale failure of the material at the top edge of the slot does not occur, repeated application of point loading at the top of the slot frequently causes abrasion or creep of the material, resulting in a slot with rounded edges which is no longer capable of transmitting torque to the screw.

The prior art exhibits several attempts to alleviate these problems. The most relevant of these attempts are described below, but none are as effective at solving the problems as the present invention.

U.S. Pat. No. 3,923,088 exhibits a blade 20 with opposing concave surfaces 22 the purpose of which is to allow the lower edge 30 of the blade to bite into the screw slot faces to resist the tendency of the blade to leave the slot. This configuration removes material from the blade, causing it to be weaker than the present invention. Because of the complicated shape, manufacture of the screw driver would also be much more difficult. If failure of the blade occurs, the average user would not be able to restore it to its original shape.

U.S. Pat. No. 3,897,812 exhibits a similar configuration with complicated contours which suffers from the same drawbacks.

U.S. Pat. No. 3,405,748 shows a straight bit 5 with parallel surfaces. Its torsion tube construction requires that for a given bit width, the shank must be considerably smaller and weaker than that of the present invention, given the same material of manufacture. It also will require a greater number of more difficult manufacturing operations, and the tube would be far more difficult to clean, a feature which is anathema to the precision work in which such tools are frequently used.

U.S. Pat. No. 1,479,506 shows a blade with concave surfaces like those previously discussed, with the same drawbacks. U.S. Pat. Nos. 4,105,056 and 4,311,071 exhibit blades with thin sections in the center which will suffer from weakness compared to the present invention and which will be more difficult to manufacture and impossible to repair.

U.S. Design Pat. Nos. Des. 112,592 and Des. 229,475 show apparently flat bits which are also difficult to manufacture and impossible to repair.

An article by Lee L. Dodds entitled "Justice for the Lowly Screwdriver" from the Aug. 26, 1946 issue of *American Machinist* magazine discloses a method of forming a screwdriver having a bit having parallel opposing surfaces. However, the screwdriver formed by the method disclosed therein suffers from two disadvantages: (1) the thickness of the bit is too thin, causing the tip to easily break when subjected to stress; and (2) there is no blade wedge, which results in the screwdriver being weaker than a standard, commercially available screwdriver. The further out one goes to apply torque, the more leverage there is. The inventor of the present invention took a commercially available screwdriver and modified it according to the American Machinist article and it broke the first time it was used.

Simpson et al., U.S. Pat. No. 4,878,406, discloses a screwdriver which has a bit having parallel faces and having a height approximately equal to its thickness. Because the height of the bit is approximately equal to its thickness, the bit can only engage a relatively small range of screw slots—the bit cannot fit in screw slots narrower than it, and in screw slots having a thickness greater than that of the bit, the screw will be contacted further up on the wedge-shaped blade, and thus no stress will be put on the bit (also, the edges of the screw slot will not be contacted by the parallel faces of the bit—thus, there is no advantage to using that screwdriver over conventional screwdrivers in larger screw slots).

Weible et al., U.S. Pat. No. 5,001,948, discloses a screwdriver having a bit which has parallel faces and is shaped to fit round screws, the screwdriver blade having increased thickness at areas which the patent describes as being high-stress areas. However, as with the '406 patent, the bit will not contact the sides of a screw slot when inserted into a screw slot which is thicker than the bit.

SUMMARY OF THE INVENTION

The object of the present invention is to produce a screw driver which will not easily twist out of a standard straight screw slot. This is accomplished by constructing a blade on the end of a shank with a bit which has parallel opposing surfaces. This ensures that the contact between the screw driver and the screw slot occurs along two parallel or very nearly parallel lines rather than at two points located on sharply diverging lines as found in the most common screw driver. The advantages it exhibits over the prior art are that it is easily manufactured, it is easily repaired, it fits a standard screw slot, and it does not involve the removal of any material, which would reduce strength. It can feature a shank of any known configuration, including round and multifaceted. It can feature a single taper along the edge of the bit while the two other opposing surfaces are parallel, or it can feature a bit with two sets of opposing parallel sides.

It has been found by the inventor that there are certain minimum thicknesses for the bit which are advantageous if one does not want the bit to easily break, and certain minimum desirable thicknesses if one does not want the bit to break under normal working conditions. Further, the inventor has determined torque tolerances which the bit should be able to withstand to perform the jobs normally performed by commercially available screwdrivers of a similar size. The desired torque tolerances can be achieved by using high quality steel hardened to a predetermined hardness.

The preferred method of making the screwdriver of the present invention is by die-pressing and grinding. However, one can make the present invention by starting with a standard commercial wedge-blade screwdriver and grinding off metal, in a manner to be described further. The present invention could also be made by stamping, casting in a mold, and laser cutting; with these methods it would be easier to make screwdrivers which are stronger than screwdrivers made by grinding to make the bit parallel. In any case, the screwdriver of the present invention is preferably manufactured without a handle, then after the metal is finished being worked, the handle is added.

BRIEF DESCRIPTION OF THE DRAWINGS

For a further understanding of the nature, objects, and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENTS

The invention involves a screw driving device having a special construction at one end for engaging a screw.

Figures 1, 2, 3, 4:
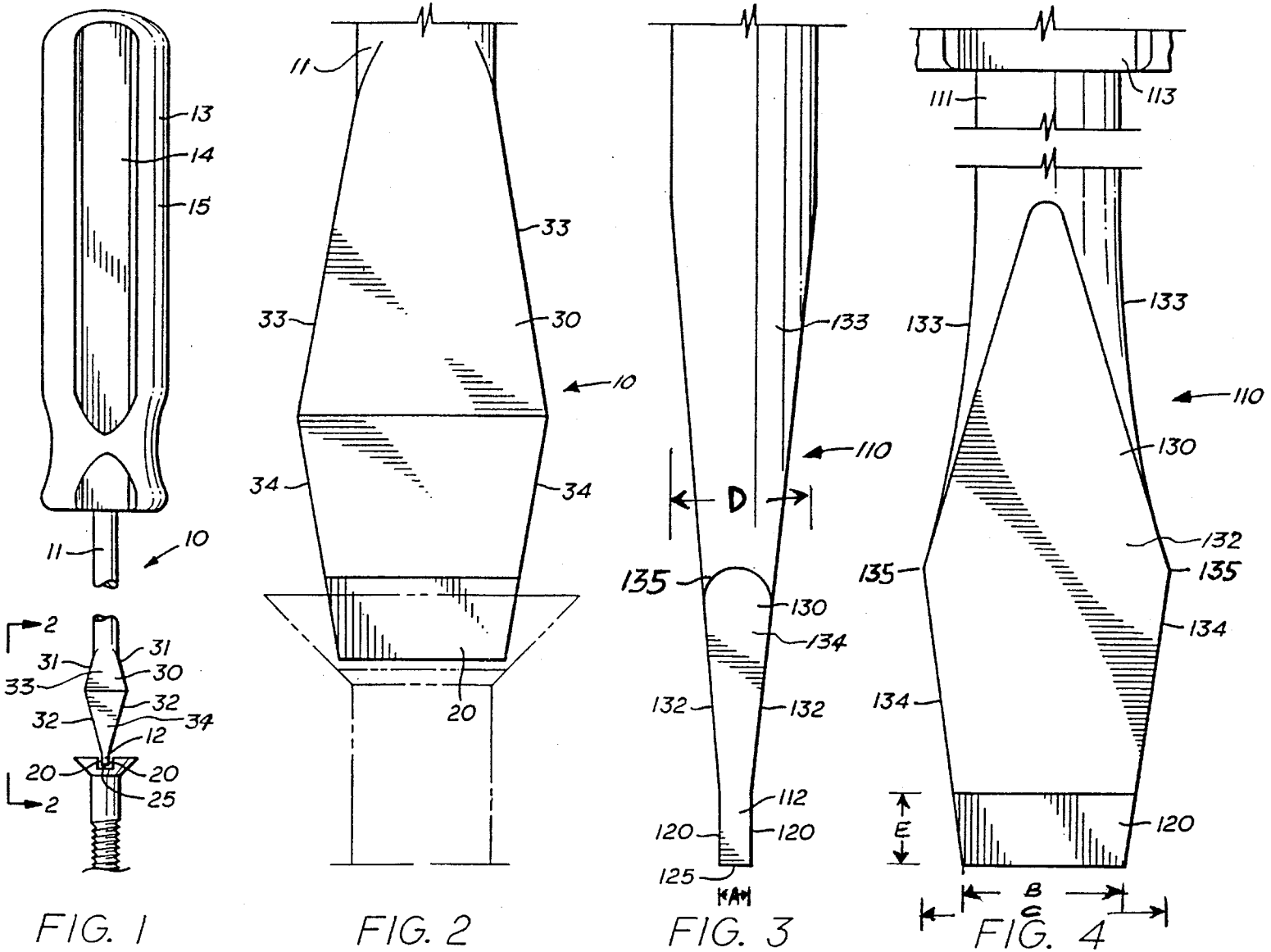
FIG. 1 is an elevation of the screw driving device showing an end view of the slot in a typical screw head and an edge of the bit of the screw driving device as it fits into a typical slot.
FIG. 2 is an elevation of the invention rotated 90° from the view of FIG. 1.
FIG. 3 is an elevation of the preferred embodiment of the invention showing an edge view of the bit.
FIG. 4 is an elevation of the preferred embodiment of the invention rotated 90° from the view of FIG. 3.

As shown in FIGS. 1 and 2, the first embodiment of the screw driving device 10 comprises a shank 11 with a bit 12 on one end and a handle 13 on the other end. In the preferred embodiment, the handle 13 features multiple longitudinal ribs 14 around its perimeter with grooves 15 in between to facilitate gripping by hand. Alternatively, other driving means can be used in place of the handle shown, such as a square socket to engage a ratchet driver.

The shank 11 extends from the handle 13 to the end surface 25 in one piece. Near the bit 12, the shank 11 is formed into a blade 30 which varies in cross-sectional area, first increasing by virtue of outwardly tapering surfaces 31,33 then decreasing by virtue of inwardly tapering surfaces 32,34. From the end of surface 32 to the end surface 25, the bit 12 has parallel surfaces 20 on two opposite sides while tapering surfaces 34 continue to surface 25, which is flat, rectangular, and perpendicular to the longitudinal axis of the shank 11. Surfaces 20, as can be seen in FIGS. 1 and 2, are parallel to the longitudinal axis of shank 11 and are parallel to the longitudinal axis of the screw slot. Other than the cross-sectional variations described, the shank 11 can be round or multifaceted in cross-section as desired, such options being well known to those skilled in the art.

As can be seen in FIGS. 1 and 2, the cross-sectional area of bit 12 is not greater than the cross-sectional area of blade 30 at the point at which the blade meets the bit. Also, the cross-sectional area of bit 12 at the point at which blade 30 meets bit 12 is substantially equal to the cross-sectional area of blade 30 at that point.

Screwdriver 110, the preferred embodiment of the invention, is shown in FIGS. 3 and 4 and includes a handle 113, shank 111, blade 130, and a bit 112. Shank 111 extends from the handle 113 to the blade 130 where outwardly tapering surfaces 133 increase the transverse dimension of the shank beginning at the approximate longitudinal location where inwardly tapering surfaces 132 begin. Surfaces 133 can have a flat or a contoured configuration. At the second edge of surfaces 133, inwardly tapering surfaces 134 begin reducing said transverse dimension to its termination at surface 125. Inwardly tapering surfaces 132 terminate at parallel surfaces 120 which also terminate at surface 125, which is flat, rectangular, and perpendicular to the longitudinal axis of the shank 111.

It is desirable to have flares 135, as they allow screwdriver 110 to have more leverage and place less strain on the bit 112 and screw head, as well as causing less torque strength to be needed by the person using screwdriver 110. Flares 135 have a width C indicated in FIG. 4. Width C is preferably greater than shank diameter D indicated in FIG. 3.

As can be seen in FIGS. 3 and 4, the cross-sectional area of bit 112 is not greater than the cross-sectional area of blade 130 at the point at which the blade 130 meets the bit 112. Also, the cross-sectional area of bit 112 at the point at which blade 130 meets bit 112 is substantially equal to the cross-sectional area of blade 130 at that point.

Figures 5, 6, 7, 8:
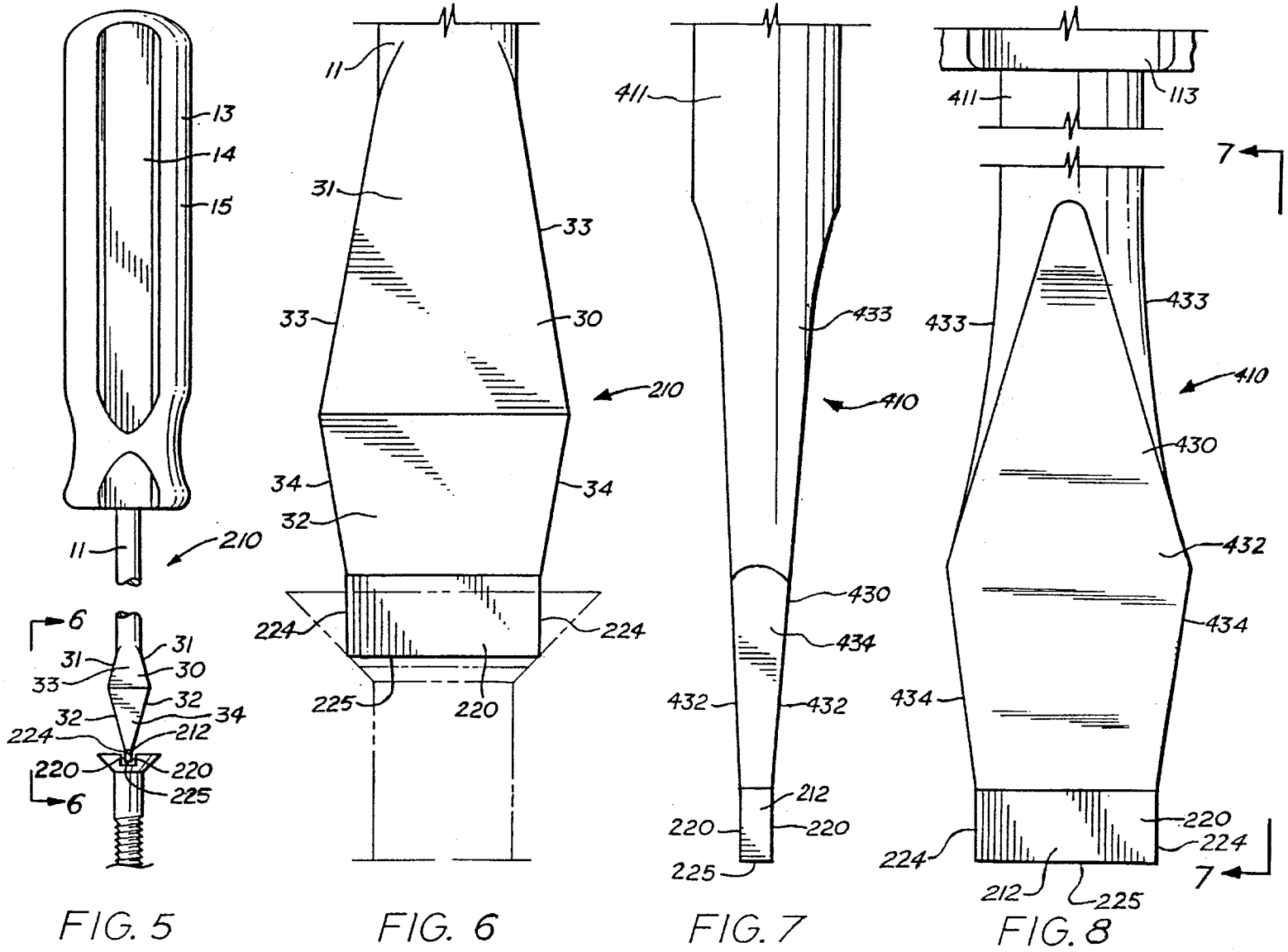
FIG. 5 is an elevational view of a screwdriver similar to the one shown in FIGS. 1 and 2, but with the bit having two pairs of parallel opposing surfaces.
FIG. 6 is an elevational view of the screwdriver of FIG. 5 taken in the direction of arrows 6 in FIG. 5.
FIG. 7 is an elevational view of a screwdriver similar to that shown in FIGS. 3 and 4, but with the bit having two pairs of parallel opposing surfaces and the blade having two curved surfaces tapering down to the bit.
FIG. 8 is an elevational view of the screwdriver of FIG. 7 rotated 90°.

Screwdriver 210, shown in FIGS. 5 and 6, is similar to screwdriving device 10, but differs therefrom in that its bit 212 has two pairs of parallel opposing surfaces, surfaces 220 and surfaces 224. Surface 225 is preferably flat, rectangular, and perpendicular to the longitudinal axis of shank 11, like surface 25 of screwdriving device 10. Having surfaces 224 parallel to each other increases the area of surface 220 as compared to surface 20 of screw driving device 10, resulting in a larger area of contact between bit 212 and the screw slot than is possible with bit 12.

The blade 430 of screwdriver 410 (FIGS. 7 and 8) is similar to blade 130 of screwdriver 110, while its bit 212 is the same as that of screwdriver 210. Screwdriver 410 comprises a shank 411 extending from handle 113 to blade 430, where outwardly tapering surfaces 433 increase the transverse dimension of shank 411 beginning at the approximate longitudinal location where inwardly tapering surfaces 434 begin. Surfaces 433 can have a flat or contoured configuration. At the second edge of surfaces 433, inwardly tapering surfaces 434 begin reducing said transverse dimension to its termination at surfaces 224. Inwardly tapering surfaces 432 curve slightly inward as they taper down and terminate at parallel surfaces 220.

As can be seen in FIGS. 7 and 8, the cross-sectional area of bit 212 is not greater than the cross-sectional area of blade 430 at the point at which the blade 430 meets the bit 212. Also, the cross-sectional area of bit 212 is substantially equal to the cross-sectional area of blade 430 at that point.

Figures 9, 10:
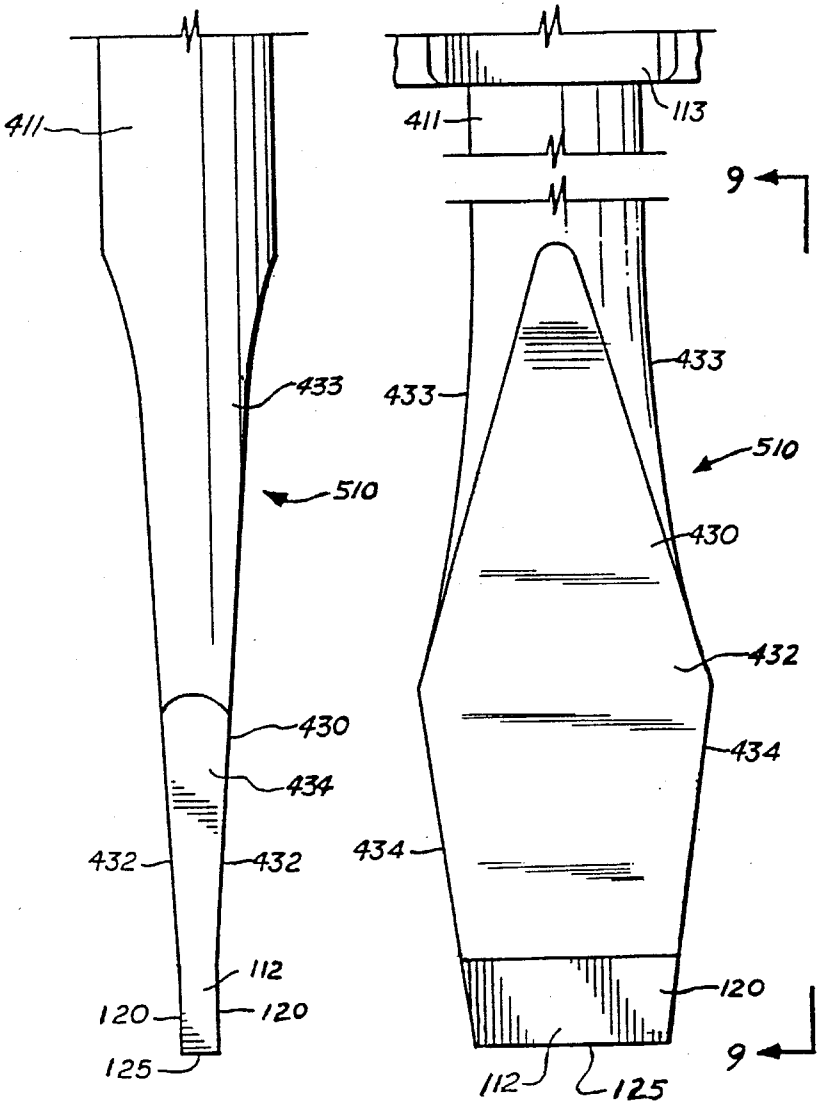
FIG. 9 is an elevational view of a screwdriver similar to that shown in FIGS. 3 and 4, but with the blade having two curved surfaces tapering down to the bit.
FIG. 10 is an elevational view of the screwdriver of FIG. 9 rotated 90°.

Screwdriver 510, shown in FIGS. 9 and 10, is similar to screwdriver 410, but has the bit 112 of screwdriver 110 instead of bit 212.

The bit of screwdrivers 10, 110, 210, 410, and 510 preferably has a thickness as shown in Table 1 or in Table 2.

TABLE 1

SCREWDRIVERS OF THE PRESENT INVENTION
BIT THICKNESS AS A FUNCTION OF BIT WIDTHS

| Range of Bit Widths (B)/ Typical Shank Size (D) for this range//Recommended bit width for the typical shank size | Minimum Bit Tip Thickness (A) for this range of bit widths | Recommended Range of Tip Thickness (A) for this range of bit widths | Preferred Tip Thickness (A) for this range of bit widths |
|---|---|---|---|
| 451/1000"–600/1000"/1/2"//500/1000" | 52/1000" | 58/1000"–110/1000" | 85/1000" |
| 396/1000"–450/1000"/7/16"//420/1000" | 48/1000" | 55/1000"–95/1000" | 78/1000" |
| 356/1000"–395/1000"/3/8"//370/1000" | 46/1000" | 52/1000"–85/1000" | 72/1000" |
| 291/1000"–355/1000"/5/16"//330/1000" | 44/1000" | 50/1000"–70/1000" | 60/1000" |
| 226/1000"–290/1000"/1/4"//255/1000" | 34/1000" | 36/1000"–55/1000" | 45/1000" |
| 131/1000"–225/1000"/3/16"//190/1000" | 26/1000" | 29/1000"–42/1000" | 36/1000" |
| 20/1000"–130/1000"/1/8"//120/1000" | 20/1000" | 22/1000"–30/1000" | 26/1000" |

TABLE 2

SCREWDRIVERS OF THE PRESENT INVENTION
BIT THICKNESS AS A FUNCTION OF SHANK DIAMETER

| Range of Shank Diameters | Minimum Bit Tip Thickness (A) for this range of shank diameters | Recommended Range of Tip Thickness (A) for this range of shank diameters | Preferred Tip Thickness (A) for this range of shank diameters |
|---|---|---|---|
| 1/2"–79/128" | 52/1000" | 58/1000"–110/1000" | 85/1000" |
| 7/16"–63/128" | 50/1000" | 55/1000"–100/1000" | 78/1000" |
| 3/8"–55/128" | 46/1000" | 52/1000"–85/1000" | 72/1000" |
| 5/16"–47/128" | 44/1000" | 50/1000"–70/1000" | 60/1000" |
| 1/4"–39/128" | 34/1000" | 36/1000"–55/1000" | 45/1000" |
| 3/16"–31/128" | 26/1000" | 29/1000"–42/1000" | 36/1000" |
| 1/8"–23/128" | 20/1000" | 22/1000"–30/1000" | 26/1000" |

TABLE 3

STANDARD,
COMMERCIALLY AVAILABLE SCREWDRIVERS

| Range of Bit Widths/ Typical Shank Size for this range | Maximum Bit Tip Thickness found for this range of bit widths | Typical Range of Tip Thickness for this range of bit widths |
|---|---|---|
| 451/1000"–600/1000"/ 1/2" | 43/1000" | 30/1000"–40/1000" |
| 396/1000"–450/1000" 7/16" | 44/1000" | 30/1000"–41/1000" |
| 356/1000"395/1000"/ 3/8" | 43/1000" | 30/1000"–40/1000" |
| 291/1000"–355/1000"/ 5/16" | 40/1000" | 25/1000"–38/1000" |
| 226/1000"–290/1000"/ 1/4" | 31/1000" | 25/1000"–30/1000" |
| 131/1000"–225/1000"/ 3/16" | 24/1000" | 15/1000"–22/1000" |
| 20/1000"–130/1000"/ 1/8" | 17/1000– | 12/1000"–17/1000" |

The minimum bit thickness is at least 3/1000" to 4/1000" larger than the tip of the typical commercially available screwdriver.

In all screwdrivers of the present invention, dimension B (the bit width) is preferably greater than or substantially equal to the shaft diameter.

The inventor of the present invention has discovered that the method described in the *American Machinist* article will not produce an acceptable screwdriver, even if one omits the last two recommended steps described in that article. The inventor has discovered that the tip of standard, commercially available screwdrivers are too thin; if one begins with a commercially available screwdriver and grinds the opposing surfaces of the bit parallel, the bit will be so thin that it will break easily. To overcome this problem, one wishing to produce screwdriver 110 as described herein from a standard, commercially available screwdriver can grind the tip down until the bit has at least the minimum thickness disclosed in Table 1, and then grind the opposing sides of the bit until they are parallel. Alternatively, one could grind the opposing sides of the bit until the upper part of the opposing sides are parallel and spaced apart a distance equal to the minimum bit tip thickness disclosed in Table 1, and then one could grind down the tip until the lower parts of the opposing sides (i.e., the parts of the opposing sides which are spaced apart less than the minimum bit tip thickness disclosed in Table 1) are ground off.

Figure 11:
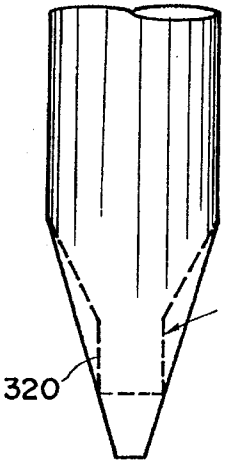
FIG. 11 shows a first method of grinding a standard, commercial screwdriver to produce the screwdriver of the present invention.
Figure 12:
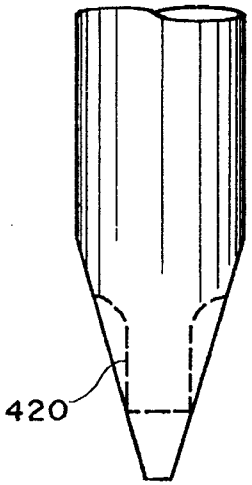
FIG. 12 shows a second method of grinding a standard, commercial screwdriver to produce the screwdriver of the present invention.

Preferably the screwdriver of the present invention is made by die pressing and grinding. It could be drop forged. It can also be ground down from an existing commercially available screwdriver. In such a case, the tip of the screwdriver would be ground off (please see FIGS. 11 and 12) until the thickness of the tip would be at least the minimum thickness specified in Table 1 (and preferably, the tip would have a flat bottom perpendicular to the longitudinal axis of the shank—forming a flat bottom is desirable because not all screwdrivers have flat, perpendicular tips or they have no flat bottom; some screwdrivers have a point at the bottom, so if one tries to grind a bit having parallel sides, the bit would be ground to nothing if a flat bottom were not formed first). It is not advisable to have a rounded bottom because that would limits its use on damaged screws where very little of the sides of the slot may be left. Then the opposing surfaces of the blade of the screwdriver would be ground back to produce a bit 320 (FIG. 11) or a bit 420 (FIG. 12). If the tip of the screwdriver were not ground off first, then the resulting bit would be too thin.

In the screwdriver shown in FIG. 12, the sides of the blade taper inwardly at least 2½ degrees, and they preferably taper inwardly a like amount in the other screwdrivers shown in the drawings.

Figure 14:
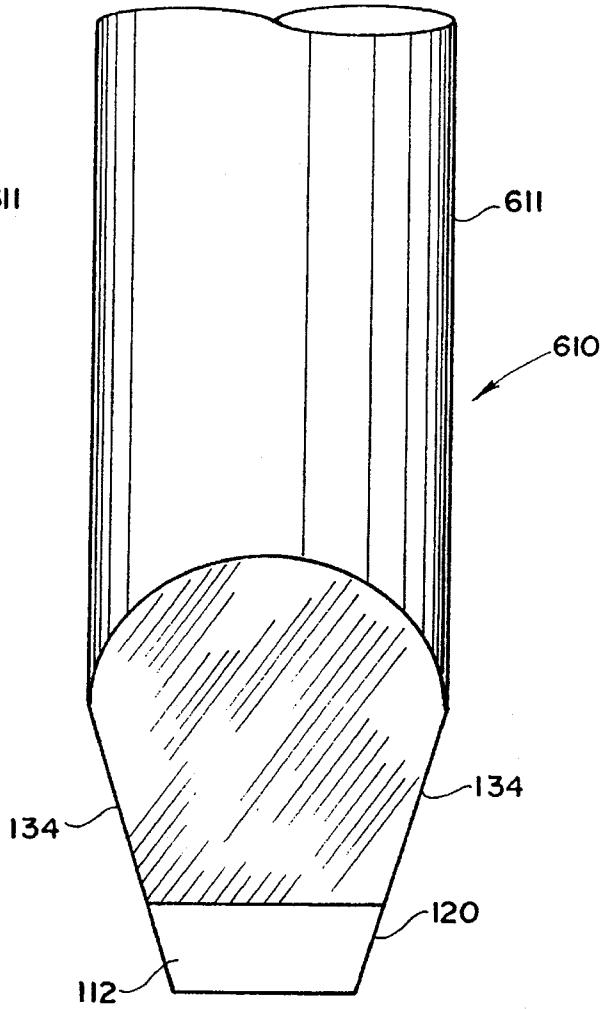
FIG. 14 is an elevation of the alternative embodiment of the invention rotated 90° from the view of FIG. 13.
Figure 13:
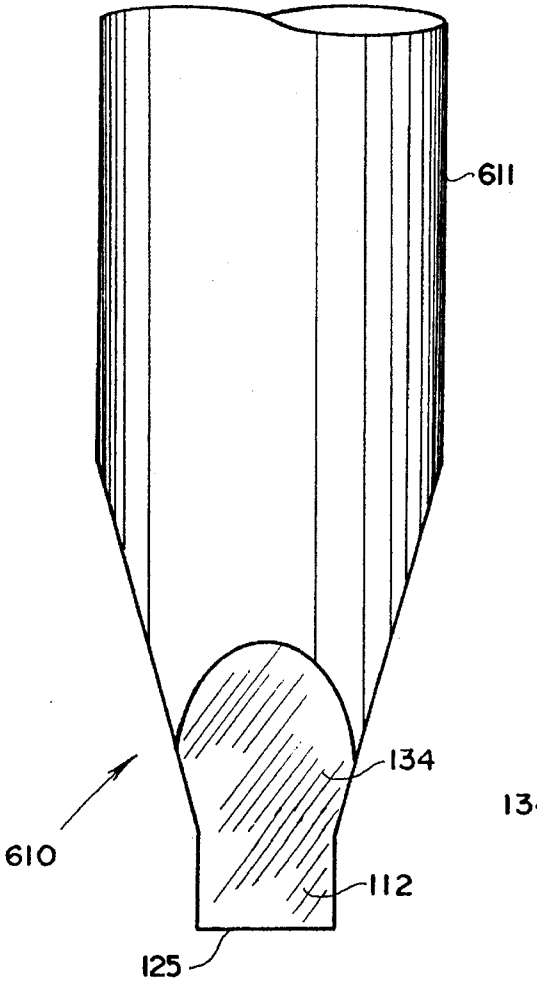
FIG. 13 is an elevation of an alternative embodiment of the invention showing an edge view of the bit.

Although the screwdriver would not be as desirable as the one shown in FIGS. 3 and 4, one could construct a screwdriver having a shank larger in diameter than the width of the bit (for example, the diameter of the shank could be equal to the width of blade 130), and wherein the blade would taper inwardly from the shank to the point at which the bit is formed without first tapering outwardly, but otherwise being the same as the screwdriver shown in FIGS. 3 and 4. Such a screwdriver, screwdriver 610, is shown in FIGS. 13 and 14. Screwdriver 610 has a relatively large diameter shank and a blade 630 which terminates where bit 112 begins. Screwdriver 610 has the relationship between bit width and bit thickness shown in Table 1.

In late 1992 the inventor produced a number of screwdrivers as shown in FIGS. 3 and 4. These screwdrivers are sold under the trademark Tytan® and have been used by mechanics and electricians, who made comments such as "Common sense idea that works great", "Eliminated slip out problems", "Screw head damage reduced", "Easier removal of screws", "It's good to see someone finally came out with a screwdriver like this", and "It does not slip off screwheads and now the Tytan driver is the only screwer I use".

Unfortunately, the bits of these screwdrivers twisted after a relatively short period of use. The bits were apparently weaker than that of regular screwdrivers because they were not wedge-shaped. The inventor of the present invention has decided to increase the torque strength of the bit of the screwdriver of the present invention by using stronger metal with less tendency to twist than regular metal used for commercial screwdrivers. Table 4 lists desired torque strengths as a function of range of shank diameters. One cannot achieve these torque tolerances with all metals—one must use specific metals hardened to specific Rockwell hardnesses to achieve the minimum torque tolerances listed in Tables 4 and 5. Examples of acceptable metals to achieve the most preferred torque strengths listed in Tables 4 and 5 include 1074, 1075, or 1078 steel hardened to about Rockwell 53, 41L40 steel hardened to about Rockwell 48, 5160 steel hardened to about Rockwell 53 or 54, and 6150 steel hardened to about Rockwell 52. By way of example, a ¼ inch screwdriver made of 1078 steel and hardened to 52–55 Rockwell could endure 180 inch-pounds of torque without twisting.

The inventor was led to determine minimum torque tolerances because of problems that he discovered when initially manufacturing a screwdriver as shown in FIG. 4.

When going to market, the inventor had a large number of screwdrivers made. The factory had promised to use an extremely high quality steel (and maybe they did use such a steel, but the inventor, not knowing the limitations of the design that he knows now, assumed that the problem was in the quality of the metal). The inventor began to give out the screwdrivers, but they were returned to him with the bits bent. The inventor stopped giving them out and began looking for a different manufacturer, thinking that the first factory had used bad steel.

The inventor found a new manufacturer, and the new manufacturer recommended a 41L40 steel without running any tests, the manufacturer having experienced this steel to be of good quality. Thinking the steel to be of better quality than the steel used in the first screwdrivers, the inventor then paid to have a die made and he placed an order for 10,000 screwdrivers.

The manufacturer ordered the steel and ran some samples, then sent them to the inventor for approval. The samples the manufacturer sent were not hardened. Having already had problems with the first screwdrivers he had made, the inventor called the new manufacturer and asked it to harden some for him, so that he could try them out. The manufacturer sent five hardened samples down to him and he thought that they looked very good. The inventor tried one of them out on a normal wood screw and had no problems, but when he began to apply a little extra torque on it, the bit bent. At this point, the inventor went to a hardware store and bought a normal, inexpensive screwdriver. The inventor tried to put similar torque as he was putting on the hardened samples, and could not distort their tips. The inventor called the manufacturer and canceled the order for 10,000 screwdrivers.

The inventor and the manufacturer began to look at the problem from a different point of view. The steel that was acceptable for the wedge design of normal, commercial screwdrivers, was not satisfactory for the design of the present invention. What happens in practice is that if during use one tilts the screwdriver of FIG. 4 ever so slightly while turning the screw, the bottom of the tip on one side touches the bottom of the slot while the opposite side touches at the top, causing a leverage effect—just like using the screwdriver as a crow bar—twisting the tip. No one can keep a screwdriver perfectly perpendicular to the screw slot while using it by hand—it can only be done by using a drill press. This same effect does not occur on a wedge design because, even if one tilts the screwdriver, the point of contact always remains at the top of both sides of the slot.

At this point, the inventor decided to choose a commercially available screwdriver, have it tested both in material composition and torque capability, then try to find a steel that could meet the performance. The inventor chose a ¼" high quality name-brand screwdriver, and sent one to the factory. The factory ran material composition tests and tip torque tests so that they could determine a suitable steel to use for a commercial grade and professional quality. It was decided to run these tests because the inventor could not find a manufacturer which could recommend a metal that would have the required torque capability.

The inventor had the manufacturer make a screwdriver as in FIG. 4 having a ¼" shank and a 46/1000" bit thickness, out of 5160 steel. It was hardened up to about Rockwell 53 or 54. The bit was able to withstand about 130–135 inch-lbs. of torque before twisting.

TABLE 4

SCREWDRIVERS OF THE PRESENT INVENTION
TORQUE STRENGTH OF THE BIT AS A FUNCTION OF SHANK DIAMETER

| Range of Shank Diameters | Minimum Torque Strength (inch-lbs.) for this range of shank diameters | Preferred Torque Strength (inch-lbs.) for this range of shank diameters | More Preferred Torque Strength (inch-lbs.) for this range of shank diameters | Most Preferred Torque Strength (inch-lbs.) for this range of shank diameters |
|---|---|---|---|---|
| 1/2"–79/128" | 145 | 150 | 160 | 180 |
| 7/16"–63/128 | 125 | 135 | 140 | 160 |
| 3/8"–55/128" | 100 | 105 | 115 | 135 |
| 5/16"–47/128" | 80 | 85 | 95 | 115 |
| 1/4"–39/128" | 60 | 65 | 75 | 95 |
| 3/16"–31/128" | 30 | 40 | 45 | 65 |
| 1/8"–23/128" | 10 | 15 | 20 | 40 |

TABLE 5

SCREWDRIVERS OF THE PRESENT INVENTION TORQUE STRENGTH OF THE BIT AS A FUNCTION OF BIT WIDTH

| Range of Bit Widths (B)/Typical Shank Size (D) for this range// Recommended bit width for the typical shank size | Minimum Torque Strength (inch-lbs.) for this range of Bit Widths | Preferred Torque Strength (inch-lbs.) for this range of Bit Widths | More Preferred Torque Strength (inch-lbs.) for this range of Bit Widths | Most Preferred Torque Strength (inch-lbs.) for this range of Bit Widths |
|---|---|---|---|---|
| 451/1000"–600/1000"/1/2"//500/1000" | 145 | 150 | 160 | 180 |
| 396/1000"–450/1000"/7/16"//420/1000" | 125 | 135 | 140 | 160 |
| 356/1000" 395/1000"/3/8"//370/1000" | 100 | 105 | 115 | 135 |
| 291/1000"–355/1000"/5/16"//330/1000" | 80 | 85 | 95 | 115 |
| 226/1000"–290/1000"/1/4"//255/1000" | 60 | 65 | 75 | 95 |
| 131/1000"–225/1000"/3/16"//190/1000" | 30 | 40 | 45 | 65 |
| 20/1000"–130/1000"/1/8"//120/1000" | 10 | 15 | 20 | 40 |

The height E of bit 112 is preferably 1.1 to 2 times as long as the thickness A of the bit 112. More preferably, the height E of bit 112 is 1.2 to 1.6 times as long as the thickness A of the 112. Most preferably, the height E of bit 112 is 1.25 to 1.35 times as long as the thickness A of the 112. This is advantageous because, if the bit is sufficiently long, it will be able to grip the bottom of the screw slot of damaged screws, which will make it easier to turn the screw.

The height of bit 212 preferably also bears a similar relation to the thickness of bit 212, for the same reason.

The logic behind these ratios is that this product is intended for mostly a human end user, and if the bit has a limited, relatively short, height, the consumer is obligated to use the product on screws with limited shallow slots. This in turn favors the product in the view that the shallower the slot, the smaller the screw and less torque needed to turn that screw and less chance of the bit failing. For example, consider a ¼" screwdriver with a 43/1000" tip thickness and a 45/1000" tip height, as described in the Weible et al. and Simpson et al. patents. Most slots on screws that have only 45/1000" slot depth are of ¼" or smaller in diameter (the inventor has found many slotted ¼" screws with a slot depth of 48/1000" to 55/1000"; if one used the ¼" screwdriver described in the Weible et al. and Simpson et al. patents, the slot sides would contact not the bit, but rather the blade of the screwdriver, thus acting as a normal, commercially available screwdriver). Now if one uses the ¼" screwdriver of the Simpson et al. patent on a large screw, which the consumer often does, the slot is wider and deeper, and if one pushes the screwdriver as far down as possible into the slot, the point of contact of the screwdriver with the slot sides will be in the wedge section of the bit, protecting the bit, but defeating the intended purpose of the screwdriver.

Now this is where the minimum torque and bit height come into play. If one can reach a desired torque strength on the bit, a strength that would sustain use on reasonably larger screws, one could increase the bit height and give greater versatility to the user. If the height of the bit is greater, then the bit will be able to contact the sides of deeper slots, and the screwdriver will be able to be used with a greater variety of sizes of screws and still have the bit, rather than the blade, contact the screw slot sides. This allows the parallelity of the bit to be exploited with a greater number of screws than with the screwdrivers of the prior art.

The normal, commercially available wedge-shaped screwdriver does not suffer these limitations, as the deeper the slot, the higher up on the wedge that the torque is applied. The higher up on the wedge, the greater the thickness at the point of contact, and consequently the greater the mass to absorb the stress. In other words, in the wedge-shaped design of standard, commercial screwdrivers there is no need to determine a definite torque limitation because the torque varies depending on the size of the screw slot it is placed in— the wider the slot, the higher up on the wedge will the blade of a standard screwdriver contact the edges of the slot.

In view of the numerous modifications which could be made to the preferred embodiments disclosed herein without departing from the scope or spirit of the present invention, the details herein are to be interpreted as illustrative and not in a limiting sense.

What is claimed as invention is:

1. A method of making a screwdriver, the screwdriver comprising:

(a) a shank having a longitudinal axis;

(b) a bit of rectangular cross section formed at an end of the shank, (i) the bit having first and second pairs of opposing surfaces and first and second ends, (ii) the first pair of opposing surfaces of the bit being parallel to each other, parallel to the longitudinal axis of the shank and, when the bit is inserted into a screw slot, parallel to the longitudinal axis of the screw slot;

(c) a handle for applying torque to the shank; and (d) a blade of rectangular cross section formed onto the end of the shank, upon which the bit is formed, wherein:

(i) two opposing surfaces of the blade taper inwardly to the bit, (ii) the cross-sectional area of the bit at the point at which the blade meets the bit is substantially equal to the cross-sectional area of the blade at that point, (iii) the blade has first and second ends, the second end of the blade being connected to the first end of the bit, (iv) the cross-sectional area of the second end of the blade is substantially equal to the cross-sectional area of the first end of the bit, the method comprising the steps of:

(1) forming a piece of metal into the shank, the blade, and the bit;

(2) attaching the handle to the shank after the piece of metal is formed into the shank, the blade, and the bit.

2. The method of claim 1, wherein:

the blade and the bit are formed by die pressing.

3. The method of claim 1, wherein:

the width of the bit is from $^{20}/_{1000}$" to $^{600}/_{1000}$", the diameter of the shank is from ⅛" to $^{79}/_{128}$", and the bit is able to endure at least the torque listed as minimum torque strength in Table 5 of the present specification without twisting, and the blade and the bit are formed by die pressing.

4. The method of claim 1, wherein:

the bit has a thickness and a width which have a relationship as described in Table 1 of the present specification.

5. The method of claim 1, wherein the bit has a height which is 1.1 to 2 times as great as the thickness of the bit.

6. A method of making a screwdriver, the screwdriver comprising:

(a) a shank having a longitudinal axis;

(b) a bit of rectangular cross section formed at an end of the shank, (i) the bit having first and second pairs of opposing surfaces and first and second ends, (ii) the first pair of opposing surfaces of the bit being parallel to each other, parallel to the longitudinal axis of the shank and, when the bit is inserted into a screw slot, parallel to the longitudinal axis of the screw slot;

(c) a handle for applying torque to the shank; and equal to the cross-sectional area of the blade at that point, (iii) the blade has first and second ends, the second end of the blade being connected to the first end of the bit, (iv) the cross-sectional area of the second end of the blade is substantially equal to the cross-sectional area of the first end of the bit, the method comprising the steps of:

(1) forming a piece of metal into the shank, the blade, and the bit, the blade and the bit being formed by die pressing;

(2) attaching the handle to the shank.

7. The method of claim 6, wherein:

the handle is attached to the shank after the piece of metal is formed into the shank, the blade, and the bit.

8. The method of claim 6, wherein:

the width of the bit is from $^{20}/_{1000}$" to $^{600}/_{1000}$", the diameter of the shank is from ⅛" to $^{79}/_{128}$", the bit is able to endure at least the torque listed as minimum torque strength in Table 5 of the present specification without twisting, and the handle is attached to the shank after the piece of metal is formed into the shank, the blade, and the bit.

9. The method of claim 6, wherein:

the bit has a thickness and a width which have a relationship as described in Table 1 of the present specification.

10. The method of claim 6, wherein the bit has a height which is 1.1 to 2 times as great as the thickness of the bit.

* * * * *